US008561593B2

(12) United States Patent
Shafer et al.

(10) Patent No.: US 8,561,593 B2
(45) Date of Patent: Oct. 22, 2013

(54) RANGE OF ENGINES USING COMMON RAIL FUEL SYSTEM WITH PUMP AND RAIL ASSEMBLIES HAVING COMMON COMPONENTS

(75) Inventors: Scott F. Shafer, Morton, IL (US); Zhenyu Li, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 721 days.

(21) Appl. No.: 12/718,171

(22) Filed: Mar. 5, 2010

(65) Prior Publication Data

US 2011/0214642 A1 Sep. 8, 2011

(51) Int. Cl.
*F02M 69/46* (2006.01)
*F02M 55/02* (2006.01)

(52) U.S. Cl.
USPC ..... 123/456; 123/468; 123/495

(58) Field of Classification Search
USPC ..... 123/446, 447, 455, 456, 468, 495, 497; 417/470
See application file for complete search history.

(56) References Cited

U.S. PATENT DOCUMENTS

| | | | | |
|---|---|---|---|---|
| 5,509,391 | A | 4/1996 | DeGroot | |
| 5,839,413 | A | 11/1998 | Krause et al. | |
| 6,289,878 | B1 * | 9/2001 | Blass | 123/509 |
| 6,401,693 | B1 | 6/2002 | Spanos et al. | |
| 6,615,800 | B1 | 9/2003 | Frank et al. | |
| 6,672,285 | B2 | 1/2004 | Smith et al. | |
| 6,928,984 | B1 | 8/2005 | Shamine et al. | |
| 6,981,722 | B2 | 1/2006 | Watanabe | |
| 7,131,427 | B2 | 11/2006 | Kawasaki et al. | |
| 7,389,766 | B2 | 6/2008 | Akita et al. | |
| 7,500,471 | B2 | 3/2009 | Adachi et al. | |
| 2001/0032618 | A1 | 10/2001 | Ramseyer et al. | |
| 2002/0017264 | A1 * | 2/2002 | Pong | 123/193.4 |
| 2002/0189589 | A1 | 12/2002 | Kato et al. | |
| 2002/0189885 | A1 * | 12/2002 | Ruebusch et al. | 180/305 |
| 2003/0093996 | A1 * | 5/2003 | Bogucki | 60/698 |
| 2003/0131826 | A1 | 7/2003 | Smith et al. | |
| 2004/0168494 | A1 | 9/2004 | Taudt | |
| 2004/0238308 | A1 * | 12/2004 | Cummins et al. | 192/69.8 |
| 2005/0115545 | A1 | 6/2005 | Kawasaki et al. | |
| 2006/0102152 | A1 | 5/2006 | Shinogle et al. | |
| 2006/0144367 | A1 | 7/2006 | Futonagane et al. | |
| 2007/0074504 | A1 * | 4/2007 | Driscoll et al. | 60/285 |
| 2007/0074704 | A1 | 4/2007 | Merchant et al. | |
| 2009/0177372 | A1 | 7/2009 | Akita et al. | |
| 2009/0229572 | A1 | 9/2009 | Lucas et al. | |
| 2009/0235901 | A1 | 9/2009 | Akita et al. | |
| 2009/0241907 | A1 | 10/2009 | Kondo et al. | |

* cited by examiner

*Primary Examiner* — Willis R Wolfe, Jr.
*Assistant Examiner* — Johnny Hoang
(74) *Attorney, Agent, or Firm* — Liell & McNeil

(57) ABSTRACT

A pump and rail assembly includes a plurality of quills that are compressed between quill seats on a pump and an output rail. A rail pressure control valve and a rail pressure sensor are attached to respective ends of the output rail. An inlet throttle valve is attached to a housing of the pump and rail assembly. Depending upon the application, the output rail may supply fuel to a first injection bank that includes a plurality of fuel injectors in a first common rail, and a second fuel injection bank that includes a second common rail and a plurality of fuel injectors. Different engines having different numbers of cylinders may use similar pump and rail assemblies that each include a plurality of quills, a plurality of pumping elements positioned in a pump housing and an output rail. The quills for each of the different engine applications are interchangeable but differ in number. In addition, the pumping elements of each of the different engine applications are also interchangeable but differ in number.

5 Claims, 3 Drawing Sheets

RANGE OF ENGINES USING COMMON RAIL FUEL SYSTEM WITH PUMP AND RAIL ASSEMBLIES HAVING COMMON COMPONENTS

TECHNICAL FIELD

The present disclosure relates generally to common rail fuel systems, and more particularly to a pump and rail assembly with interchangeable components for a range of engines.

BACKGROUND

Engine manufacturers are constantly seeking ways to reduce costs. One possible way of reducing costs can be by utilizing common interchangeable components to yield economies of scale. However, such a strategy can be especially problematic when a range of potential engine applications is extremely broad. For instance, Caterpillar Inc. of Peoria Ill. manufactures a broad range of compression ignition engines from as small as 4.4 liter four cylinder engines up to 106 liter 20 cylinder engines, and larger. Although these engines differ from each other in size, shape, configuration and many components, they share some features in common. Among these common features are usage of the same type of distillate diesel fuel, and the engines share in common the fact that the fuel system represents a large fraction of the cost for the engine. It is these common aspects that may represent an opportunity for finding a way to potentially utilize common components in the fuel systems for a broad range of engines.

The present disclosure is directed toward one or more of the problems set forth above.

SUMMARY

In one aspect, a pump and rail assembly includes a pump that defines a plurality of quill seats. An output rail also defines a plurality of quill seats. Each of a plurality of quills has one end in contact with the quill seat of the pump, and an opposite end in contact with a quill seat of the output rail. At least one clamp is positioned to compress the quills between the pump and the output rail.

In another aspect, a fuel system includes a pump and rail assembly with a plurality of quills, a plurality of pumping elements positioned in a pump housing, and an output rail. A first injection bank includes a plurality of fuel injectors fluidly connected to a first common rail. A second injection bank includes a plurality of fuel injectors fluidly connected to a second common rail. Each of the first and second common rails are fluidly connected to the output rail.

In still another aspect, a plurality of engines have different numbers of cylinders but common components. A plurality of first engines each have a small number of cylinders and a first fuel system with a first pump and rail assembly. A plurality of second engines each have a large number of cylinders and a second fuel system with a second pump and rail assembly. The first and second pump and rail assemblies each include a plurality of quills, a plurality of pumping elements positioned in a pump housing, and an output rail. The plurality of quills for each of the first and second pump and rail assemblies are interchangeable but differ in number. The plurality of pumping elements for each of the first and second pump and rail assemblies are interchangeable but differ in number.

DETAILED DESCRIPTION

Figure 1:
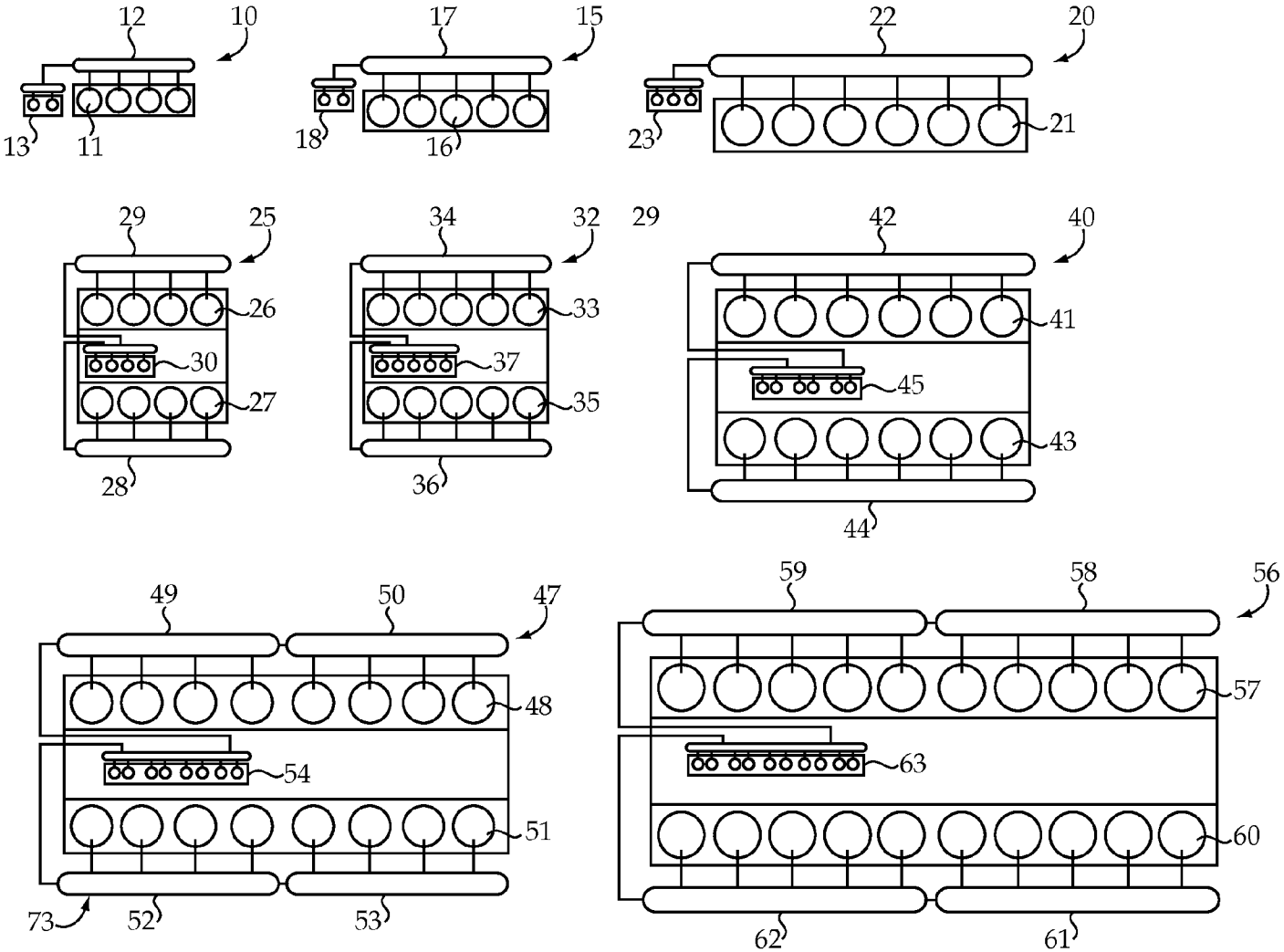
FIG. 1 is a schematic view of a range of engines.

Referring to FIG. 1, an example range of different engines are illustrated. All of the engines include common rail fuel systems that utilize similar pump and rail assemblies, but each engine differs in its number of cylinders. In particular, at the small end of the range are engines 10 that each include four cylinders a common rail 12 and a fuel and pump assembly 13 with two pumping elements. Next to that is an engine 15 with five cylinders 16 that receive fuel from a common rail 17 that is fluidly connected to a pump and rail assembly 18, also including two pumping elements. Next is an engine 20 with six cylinders 21, and a common rail 22 that receives pressurized fuel from a pump and rail assembly 23, which includes three pumping elements. Next along the range of engines is engine 25 in a V8 configuration with four cylinders 26 and one bank connected to a first common rail 29, and a second set of four cylinders 27 connected to a second common rail 28. The first and second common rails 29 and 28 are fluidly connected to a pump and rail assembly 30, which is similar to the previous pump and rail assemblies, except that it include four pumping elements. Next is engine 32 that includes ten cylinders in a V configuration with a first group of five cylinders 33 fluidly connected to a first common rail 34, and a second set of five cylinders 35 connected to a second common rail 36. The first and second common rails 34 and 36 receive pressurized fuel from a pump and rail assembly 37, which includes five pumping elements. Next, is an engine 40 that includes twelve cylinders in a V configuration with a first set of six cylinders 41 fluidly connected to a first common rail 42 and a second group six cylinders 43 fluidly connected to a second common rail 44. The first and second common rails 42 and 44 receive pressurized fuel from a pump and rail assembly 45, which includes six pumping elements that are grouped in pairs and arranged in a line as shown. Next, is a sixteen cylinder engine 47 in a V configuration with a first group of eight cylinders, half of which receive fuel from a first common rail 49 and the second half receive fuel from a common rail 50. A second bank of eight cylinders has a first group of four cylinders that receive fuel from a third common rail 52, and a second set of four cylinders that receive fuel from a fourth common rail 53. The first, second, third and fourth common rails 49, 50, 52 and 53 all receive fuel from a pump and rail assembly 54, which includes eight pumping elements grouped in pairs and arranged in a line. Finally, a twenty cylinder engine 56 includes a first bank of ten cylinders 57 with five each of the cylinders receiving fuel from respective first and second common rails 58 and 59. A second set of ten cylinders 60 includes two groups of five cylinders that receive pressurized fuel from respective third and fourth common rail 61 and 62. The first, second, third and fourth common rails 58, 59, 61 and 62 receive pressurized fuel from a pump and rail assembly 63, which includes ten pumping elements grouped in pairs and arranged in a line. The pump and rail assemblies 13, 18, 23, 30, 37, 45, 54 and 63 for the range of engines shown in FIG. 1 may be configured to include many interchangeable components so that economies of scale and the associated cost savings can be brought to bear across and entire range of engines. The details regarding the interchangeable components for the pump and rail assemblies of the engines shown in FIG. 1 are discussed infra.

Figure 2:
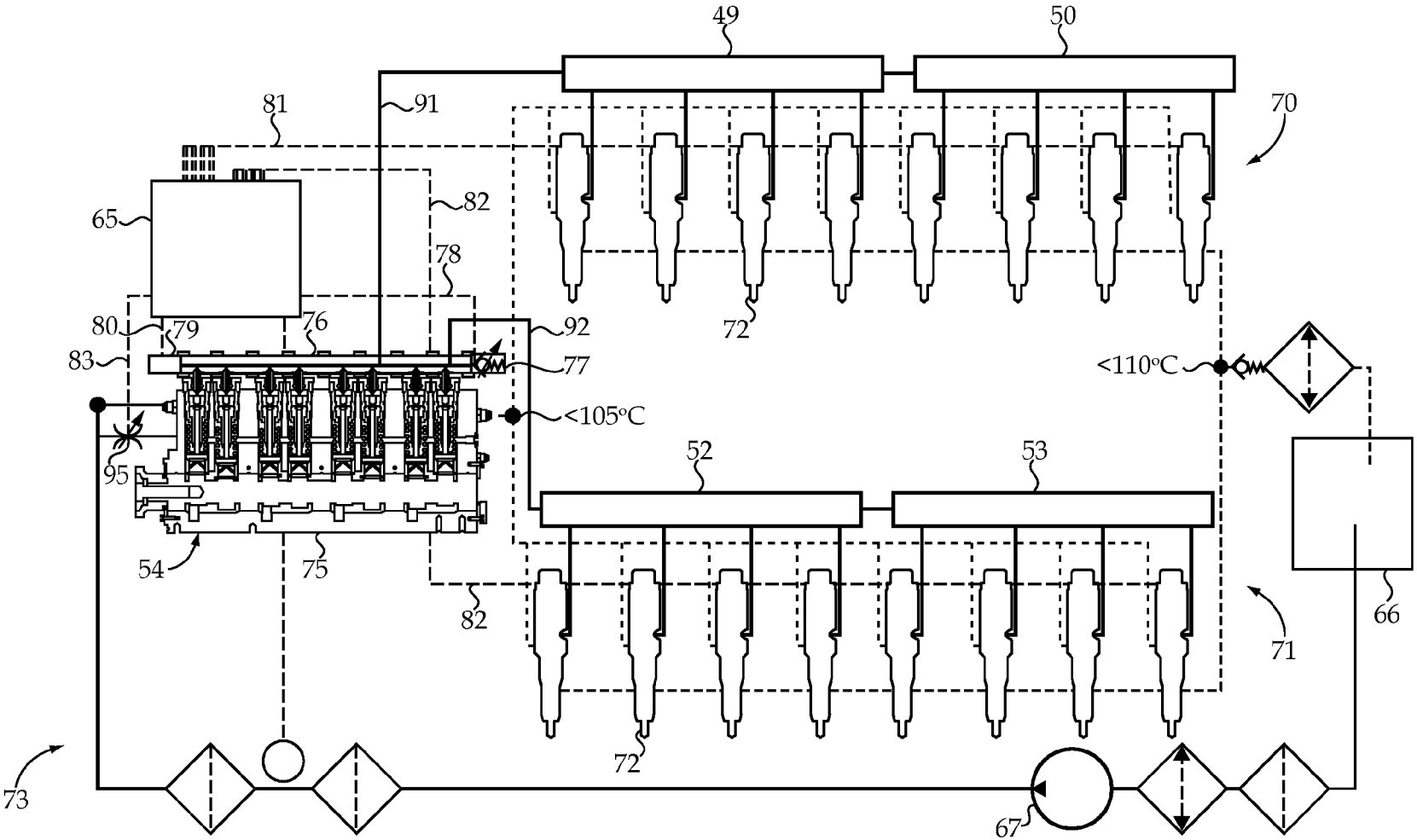
FIG. 2 is a schematic view of a fuel system for one of the engines in FIG. 1.

Referring now to FIG. 2, a fuel system 73 is that which would be associated with the sixteen cylinder engine 47 of FIG. 1. In particular, the pump and rail assembly 54 includes a pump 75 and an output rail 76 that is fluidly connected to a first injection bank 70 and a second injection bank 71 via respective high pressure fuel lines 91 and 92. The inlets of rails 49 and 52 are fluidly connected to outlets of output rail 76, while the inlets of rails 50 and 53 are connected to outlets from rails 49 and 52, respectively. First injection bank 70 includes first and second common rails 49 and 50 with outlets fluidly connected to four fuel injectors 72. In a similar manner, second fuel injection bank 71 includes third and fourth common rails 52 and 53 have outlets that are fluidly connected to a second set of eight fuel injectors 72. Fuel system 73 is controlled in its operation by an electronic controller 65, which communicates control signals to fuel injectors 72 of the first injection bank via communication lines 81 and to the fuel injectors 72 in a second injection bank 71 via communication lines 82. In this embodiment, electronic controller 65 controls the fuel pressure in common rails 49, 50, 52 and 53 by controlling fuel pressure in the output rail 76. In particular, in this embodiment, pump 75 is equipped with an inlet throttle valve 95 that controls the flow of fuel into pump 75 via control commands generated by electronic controller 65, and communicated to inlet throttle valve 95 via communication line 83. Electronic controller 65 may receive pressure information in output rail 76 via a rail pressure sensor 79 mounted at one end of output rail 76, and in communication with electronic controller 65 via communication line 80. A rail pressure control valve 72 may be attached at an opposite end of output rail 76, and may include an electrical actuator that receives control commands via a communication line 78 from electronic controller 65. A fuel transfer pump 67 has an inlet fluidly connected to a tank 66 and an outlet fluidly connected to the inlet throttle valve 95.

Figure 3:
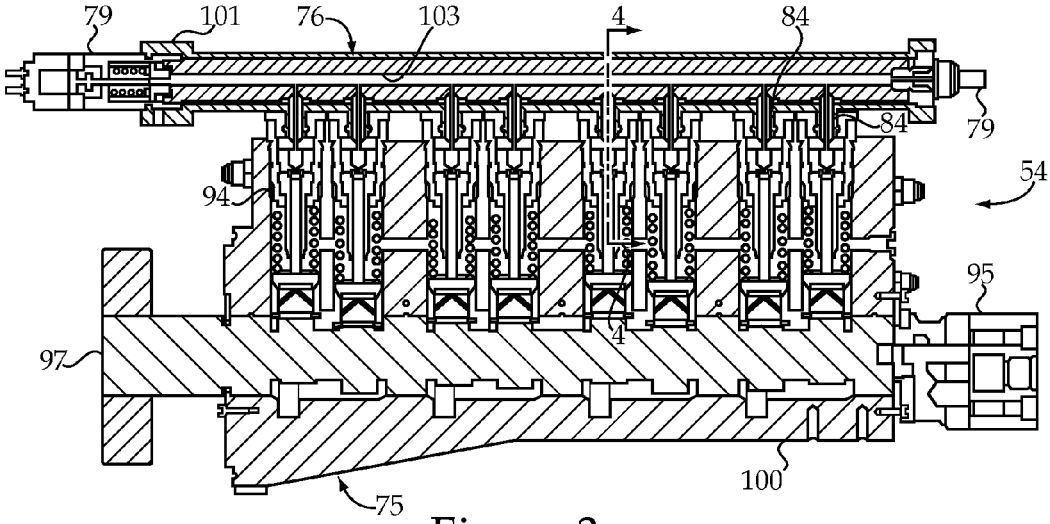
FIG. 3 is a side sectioned view of a pump and rail assembly from the fuel system of FIG. 2.
Figure 4:
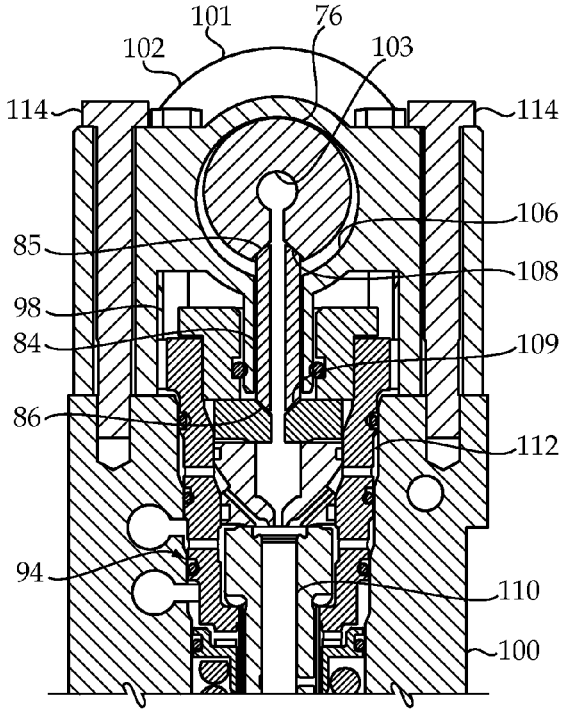
FIG. 4 is a partial sectioned view through one of the pumping elements of the pump and rail assembly of FIG. 3.
Figure 5:
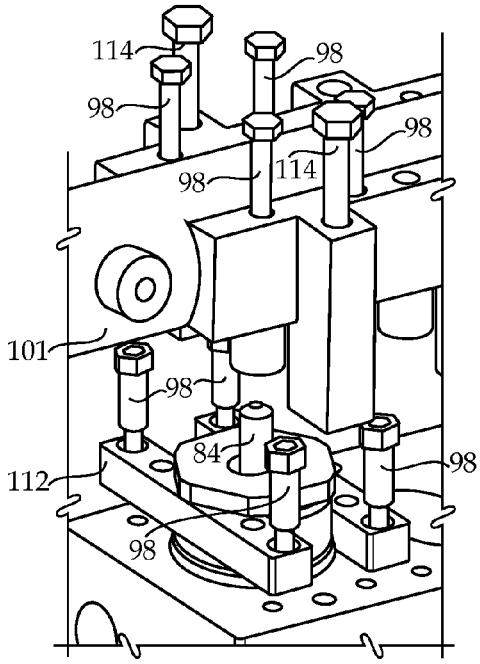
FIG. 5 is an exploded view of a portion of the pump and rail assembly of FIG. 3 above one pumping element.

Referring now to FIGS. 3-5, the pump and rail assembly 54 for the fuel system of FIG. 2 is shown in greater detail. Pump and rail assembly 54 includes a pump housing 100 that carries eight identical interchangeable pumping elements 94 that are operably coupled to a rotating cam shaft 97, which may be driven directly by the engine in a conventional manner. The inlets of each pumping element are fluidly connected to a common gallery in pump housing 100 that is supplied with controlled quantities of fuel via throttle inlet valve 95. The outlets of each individual pumping element 94 are fluidly connected to the high pressure space 103 in output rail 76 via individual quills 84. Each pumping element includes a plunger driven to reciprocate in response to rotation of cam shaft 97. The quills 84 are compressed between the pumping elements 94 of pump 75 and the output rail 76. In particular, the output rail includes a plurality of quill seats 108, which may take the form of conventional conical seats, and each of the pumping elements 94 likewise includes an outlet quill seat 109, which also may have a conventional frustoconical shape. Each of the quills may have spherical ends with a first end 85 in contact with the quill seat 108 of output rail 76, and a second spherical end 86 in contact with a respective quill seat 109 of one of the pumping elements 94. Sealing the respective ends of the quills 84 is accomplished by cam pressing the individual quills between the quill seats 108 and 109 via a suitable clamping strategy, which in the illustrated embodiment is accomplished by bolts 98. In particular, each pumping element 94 includes a pumping element housing 112 that includes four threaded openings for receiving quill clamp bolts 98. The clamping is accomplished by pulling the respective pumping element housing 112 upward toward containment component 101 as best shown in FIGS. 4 and 5. The output rail 76 is positioned within a leak collection cavity 106 of containment component 101, which acts as a leak containment vessel. When quill clamp bolts 98 are tightened, the pump element housing 112 is drawn upward push to output rail 76 against the upper interior surface of leak collection cavity 106. Further tightening then causes quills 84 to be compressed between quill seats 108 and 109 as shown in FIG. 4. The leak containment vessel 101 may itself be attached to pump housing 100 via separate means, such as a pair of bolts 114 associated with each pumping element 94 along the length of pump housing 100.

Those skilled in the art will appreciate that the pump and rail assemblies for the different engines shown in FIG. 1 differ primarily in the number of pumping elements 94 and number of quills 89 included, the length of the output rail 76 and the size of the respective pump housing 100. Otherwise, the rail pressure control valve 77, the rail pressure sensor 79 and the inlet throttle valve 95 as well as quills 84 and the individual pumping elements 94 may all be interchangeable across the entire range of engines.

Industrial Applicability

The pump and rail assembly aspect of the present disclosure finds potential use in any pump application, but especially finds potential application in common rail fuel systems for compression ignition engines. The pump and rail assembly structure also finds potential application for scaling across a large range of engines. In particular, the different pump and rail assemblies for different sized engines may differ in pump speed rate, the number of pumping elements and the number of associated quills and the size of the housing. The pump and rail assemblies may find similarity using interchangeable quills, interchangeable pumping elements, output rails formed from different lengths of a similar base material, utilize interchangeable rail pressure sensors, rail pressure control valves and even inlet throttle valves. By utilizing common components across many different sized engine applications, one can expect reduced product costs and development costs as well as reduced risk, by leveraging a common solution across many applications and by yielding economies of scale and quality within a supply chain.

For many four, five and six cylinder applications, the pump and rail assembly strategy of the present disclosure prescribes a pump having two or three pumping elements, each connected to a single high pressure rail through high pressure lines. For a larger V engine application, the solution may be more complicated. The fueling levels and number of cylinders in these applications require more pump capacity. To accomplish this, the high pressure pump configuration is selected to have anywhere from four to ten pumping elements depending upon the engine configuration. With V configurations, two or four outboard high pressure rails are positioned one or two each adjacent to a group of cylinders and their associated fuel injectors. One means to connect the high pressure pump output to the outboard rails is via high pressure lines. By utilizing the intermediate rail (output rail) concept of the present disclosure, output from all of the pumping elements is collected in the intermediate rail first, and subsequently flows to the appropriate outbound rails via connecting high pressure lines, and then later consumed by the fuel injectors in the firing order sequence of the engine. The intermediate rail also serves as an effective hydraulic dampener, softening the pressure pulses emitted from the high pressure pump elements. It also reduces tendency for Helmholtz resonance and other pressure wave interactions between the outboard injector rails. As one specific example, if the system illustrated in FIG. 2 were compared to equivalent system where four of the pumping elements supplied common rails 49 and 50 and the remaining four pumping elements supplied common rails 52 and 53, as per a probable prior art configuration, one might expect a reduction in the variance of rail pressure seen of the injector inlets to potentially reduce from about 30 MPa down to about 20 MPa.

The intermediate output rail 76 of the present disclosure may also serve as a means to reduce the effects of stack up tolerances. The short interchangeable quills 84 having spherical seats on opposite ends may be used on complimentary conical seats 108 and 109 in the output rail 36 and pumping element assemblies 94 to provide the required high pressure sealing. By utilizing a clamping strategy with a leak containment vessel 101, any leakage that does occur can be captured and returned to tank consistent with Marine Classification Society regulations. The selected sphere on cone joint design provides for good tolerance to misalignment in the horizontal plane between seats on the pumping element 94 and the output rail 36. Regarding differences in vertical distance between the conical seats 108 and 109, the assembly has been aligned so that quill clamps comprising four bolts 98 pull the individual pumping element 94 against one end of the quill 84, with the other end of the quill 84 seen against the cone in the output rail 76, which in turn pushes against the inner wall of the leakage containment vessel 101. This closes the load path and provides the required preloading for sealing each pumping element 94 to the intermediate output rail 76. The result in overall intermediate rail/containment vessel/pumping element subassembly is attached to the pump housing 100 by two attachment bolts 114 per pumping element location, providing an abutment to react to loads applied to the plungers of the pump elements 94 by the lifter assemblies as they move in response to the rotating cam shaft 97.

Either end of the output rail 76 may serve as a connection point for a rail pressure control valve 77 and rail pressure sensor 79. In the illustrated embodiment, the rail pressure control valve 77 is shown in control communication with the electronic controller 65. This aspect of the disclosure is intended to accommodate low leakage fuel injectors 72 which may be so fluidly tight that reductions in rail pressure, such as dropping an engine from a high to a low load condition, may be difficult to achieve without actually spilling some fuel from the output rail. Thus, the electronic aspect of rail pressure control valve 77 is optional. In addition, the rail pressure control valve 77 may include a conventional spring biased overpressurization valve that opens in the unlikely event that pressure in the output rail exceeds some predetermined maximum pressure for the system.

Each of the pump and rail assemblies 13, 18, 23, 30, 37, 45, 54 and 63 may also include an interchangeable inlet throttle valve 95 in which fuel to a fuel gallery within the pump 75 is controlled, to control output from the pump 75 and hence to control pressure in the output rail 76. Each of the pumping elements 94 for a given pumping rail assembly 54 would draw fuel from the common fuel inlet manifold within the pump housing 100. Thus, the illustrated embodiment has the advantage of utilizing a single throttle inlet valve 95 regardless of the number of pumping elements for a given pump and rail assembly application. Nevertheless, those skilled in the art will appreciate the alternative pump output control strategies could be utilized, such as individual spill valves associated with each pumping element.

It should be understood that the above description is intended for illustrative purposes only, and is not intended to limit the scope of the present disclosure in any way. For instance, the total number of pumping elements need not necessarily equal the number of fuel injectors in each injection bank for the V configuration engine 25, 32, 40, 47 and 56. Thus, those skilled in the art will appreciate that other aspects of the disclosure can be obtained from a study of the drawings, the disclosure and the appended claims.

What is claimed is:

1. A plurality of engines having different numbers of cylinders but common components, comprising:

a plurality of first engines, each having a small number of cylinders and a first fuel system with a first pump;

a plurality of second engines, each having a large number of cylinders and a second fuel system with a second pump;

the first and second pumps each include a plurality of pumping elements positioned in a pump housing, and each of the pumping elements includes a plunger driven to reciprocate in response to rotation of a cam shaft; and each of the plurality of pumping elements for the first pump being interchangeable with each of the plurality of pumping elements of the second pump, and the first pump has a different number of the pumping elements than the second pump.

2. The engines of claim 1 wherein the first fuel system includes at least one common rail with a plurality of outlets fluidly connected to respective first fuel injectors; and the second fuel system includes at least one common rail with a plurality of outlets fluidly connected to respective second fuel injectors.

3. The engines of claim 2 wherein each of the first and second pumps includes an interchangeable rail pressure sensor; and each of the first and second pumps includes an interchangeable rail pressure control valve.

4. The engines of claim 3 wherein each of the second engines has a V configuration of cylinders, a first injection bank that includes a plurality of fuel injectors fluidly connected to a first common rail, a second injection bank that includes a plurality of fuel injectors fluidly connected to a second common rail; and a total number of fuel injectors in each of the first and second injection banks being equal to a total number pumping elements in the second pump.

5. The engines of claim 1 wherein the first pump includes a first electronically controlled inlet throttle valve;

the second pump includes a second electronically controlled throttle inlet valve; and the first electronically controlled inlet throttle valve is identical to, and interchangeable with, the second electronically controlled throttle inlet valve.

* * * * *

UNITED STATES PATENT AND TRADEMARK OFFICE

CERTIFICATE OF CORRECTION

PATENT NO. : 8,561,593 B2
APPLICATION NO. : 12/718171
DATED : October 22, 2013
INVENTOR(S) : Shafer et al.

It is certified that error appears in the above-identified patent and that said Letters Patent is hereby corrected as shown below:

In the Specification

Column 4, line 24, delete "Industrial Applicability" and insert -- INDUSTRIAL APPLICABILITY --.

Signed and Sealed this
Eighteenth Day of August, 2015

Michelle K. Lee

Michelle K. Lee
*Director of the United States Patent and Trademark Office*